US006640721B1

(12) United States Patent
Standback et al.

(10) Patent No.: US 6,640,721 B1
(45) Date of Patent: Nov. 4, 2003

(54) NON-LETHAL AIRBAG MUNITION

(75) Inventors: Andre L. Standback, Fredericksburg, VA (US); Sean Stapf, White Plains, MD (US); Gary Prybyla, LaPlata, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/208,857

(22) Filed: Aug. 1, 2002

(51) Int. Cl.[7] ..... F42B 23/04; F42B 23/10

(52) U.S. Cl. ..... 102/401; 102/429; 102/498; 102/530; 89/1.11

(58) Field of Search ..... 102/293, 395, 102/401, 404, 405, 428, 429, 498, 502, 529, 530, 531; 89/1.11

(56) References Cited

U.S. PATENT DOCUMENTS

| | | | | | |
|---|---|---|---|---|---|
| 5,069,136 | A | * | 12/1991 | Axelson et al. | 102/401 |
| 5,092,244 | A | * | 3/1992 | Giglia | 102/293 |
| 5,216,198 | A | * | 6/1993 | Bourgin | 102/401 |
| 5,221,809 | A | | 6/1993 | Cuadros | 102/439 |
| 5,503,059 | A | | 4/1996 | Pacholok | 89/1.11 |
| 5,649,466 | A | | 7/1997 | Genovese | 89/1.11 |
| 5,792,976 | A | | 8/1998 | Genovese | 102/293 |
| 5,955,695 | A | | 9/1999 | McNulty, Sr. | 89/1.11 |
| 6,298,787 | B1 | | 10/2001 | Warnagiris | 102/502 |
| 6,363,854 | B1 | * | 4/2002 | Schweitzer | 102/401 |
| 2002/0178960 | A1 | * | 12/2002 | Ramaswamy | 102/439 |

FOREIGN PATENT DOCUMENTS

| | | | | |
|---|---|---|---|---|
| DE | 4032631 | * | 4/1992 | 102/401 |
| GB | 2245689 | * | 1/1992 | 102/401 |

* cited by examiner

*Primary Examiner*—Harold J. Tudor
(74) *Attorney, Agent, or Firm*—Mark Homer

(57) ABSTRACT

A non-lethal airbag munition which can be used alone or in combination with anti-tank landmines to prevent target pedestrians and vehicles from entering a specific area or following a particular route for a period of time is disclosed. The munition can inflict severe ankle and foot injuries to target pedestrians but discriminates based upon the weight of the target.

11 Claims, 4 Drawing Sheets

NON-LETHAL AIRBAG MUNITION

STATEMENT OF GOVERNMENT INTEREST

The invention described herein may be manufactured and used by or for the Government of the United States of America for governmental purposes without payment of any royalties thereon or therefor.

1. Field of the Invention

The present invention relates to area-denial devices, more particularly to a nonlethal airbag munition which can be used alone or in combination with anti-tank landmines to prevent target pedestrians, particularly warfighters, from entering a specific area or following a particular route for a period of time.

2. Description of the Prior Art

For some time, both military and law enforcement agencies have been investigating alternatives to conventional non-lethal weapons.

It is well known that the kinetic energy in a relatively small projectile is sufficient to stun, disable, and/or bring a person to the ground. Evidence of this occurs in combat situations when a small arms projectile impacts a relatively large surface, such as a bulletproof vest, worn by the person fired upon. If the projectile does not penetrate the surface or object fired upon, most of the kinetic energy is distributed over the surface, and tends to stun or bring down the targeted personnel. Little or no long-term damage results from the lack of penetration of the projectile.

Taking advantage of this principle, several non-lethal weapons have been developed. Some use large projectiles to minimize the possibility of penetration.

Current law enforcement capabilities for immobilizing perpetrators of hostile or other inappropriate action include the use of riot control chemical dispensers, grenades and canisters. The use of such dispensers to deploy riot control material such as tear gas or mace is a preferred immobilizing technique. A less desirable alternative is the use of extreme force via firearms and the like. Although riot control materials, such as tear gas, have served the purpose, they have not proved entirely satisfactory under all conditions of service because they do not always accomplish the desired results. The effects of such riot control materials on personnel are unpredictable, ranging from having little or no effect to inducing hyperactive responses. In some extreme cases, the use of lethal force becomes necessary even though its use is seldom condoned by most law enforcement officials. Likewise, the use of less than lethal extreme forces, e.g., via a policeman's club, a high-powered water hose, rubber bullets, etc., is currently not acceptable in most law enforcement scenarios.

Another well known non-lethal force protection munition which functions as an area denial device is the TASER® technology which is similar to an anti-personnel mine. The TASER® technology employs multiple independent stand-off incapacitation devices that can temporarily incapacitate a subject without serious injury. The devices are activated by sensors after firing one or more high voltage leads at a subject.

Other non-lethal force protection munitions are known in the art. For example, U.S. Pat. No. 6,298,787 is directed to a method of operating a non-lethal kinetic energy system. comprising a personnel target proximity detection means, an air bag and a means to inflate the air bag responsive to a signal provided by the proximity detection means. The method comprises the steps of: a) deploying the system toward a personnel target; b) sensing the proximity of the target; c) sending a signal to the air bag inflation means at a predetermined distance from the target; and d) inflating the air bag before impacting the target.

U.S. Pat. No. 5,792,976 discloses a rapidly deployable volume-displacement system and method for restraining the movement of objects having a plurality of restraining elements with each element including a deployable volume-displacement device that rapidly increases its volumetric size when deployed. A package containing the elements is placed in the area. The restraining elements comprise a propellant, a primer and an inflatable bag that is rapidly inflated by the propellant when fired by the primer.

SUMMARY OF THE INVENTION

There is currently a need for a non-lethal airbag munition which will provide nonlethal area defense and does not rely on proximity detection and may inflict severe ankle or foot injury and yet is discriminating based upon the weight of a target pedestrian.

The present inventive subject matter is directed to a non-lethal airbag munition which comprises a top and a base with the base being adapted to contain a propellant material. The non-lethal airbag munition has an initiator body containing at least one gas vent and means for initiating the propellant material. The initiator body is fixed to and sealed from the base and is positioned above the propellant material. The initiation means is positioned inside the top of the initiator body. A flexible sleeve is attached to and seals the top and the base with the sleeve being capable of compressing when the top and the base are in a compressed state and expanding in an axial direction when the propellant material is initiated. Application of pressure by a target pedestrian on the munition top lowers the initiation means and ignites the propellant material and produces gas pressure which act upon the top.

It is also a feature and advantage of the inventive subject matter to provide a non-lethal munition whose initiation discriminates based upon the weight of a target pedestrian.

The foregoing and other features and advantages will become further apparent from the following detailed description of the presently preferred embodiments, when read in conjunction with the accompanying examples and made with reference to the accompanying drawings. It should be understood that the detailed description and examples are illustrative rather than limitative, the scope of the present invention being defined by the appended claims and equivalents thereof.

DETAILED DESCRIPTION OF THE PREFERRED EMBODIMENTS

In accordance with the present invention, there is generally provided a non-lethal airbag munition comprising a top and a base with the base being adapted to contain a propellant material. An initiator body containing at least one gas vent and containing means for initiating the propellant material with the initiator body being fixed to and sealed from the base and is positioned above the propellant material. The initiation means is disposed inside the top of the initiator body. A flexible sleeve is attached to and seals the top and the base with the sleeve being capable of compressing when the top and the base are in a compressed state and expanding in an axial direction when the propellant is initiated, wherein upon application of pressure by a target pedestrian on the munition top lowers the initiation means, igniting the propellant and producing gases which act upon the top.

Figure 1:
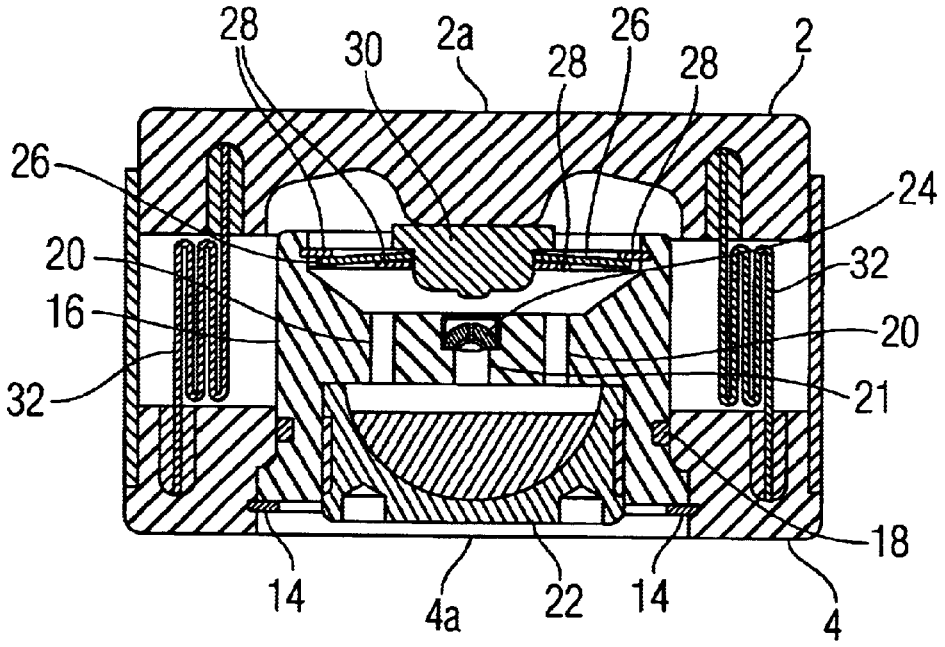
FIG. 1 is a side view of the non-lethal airbag munition assembly.
Figure 2:
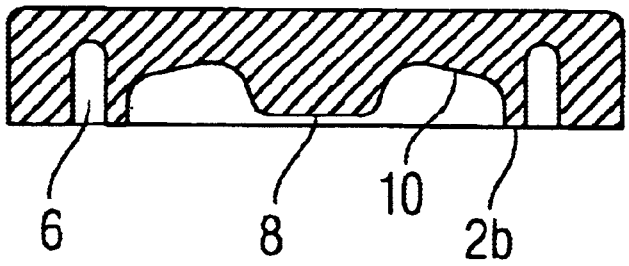
FIG. 2 is a side view of the non-lethal airbag munition top.
Figure 3:
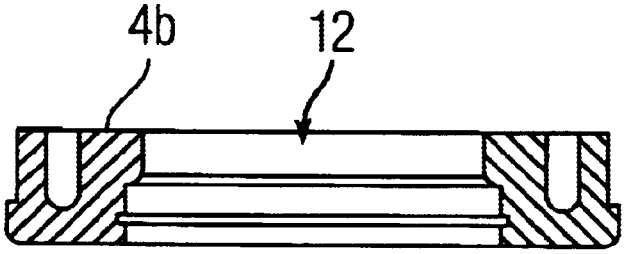
FIG. 3 is a side view of the non-lethal airbag munition base.
Figure 4:
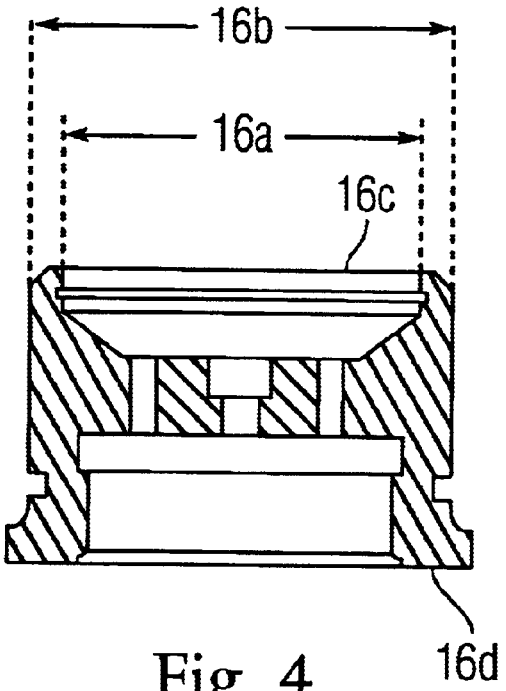
FIG. 4 is a side view of the initiator body.
Figure 5:
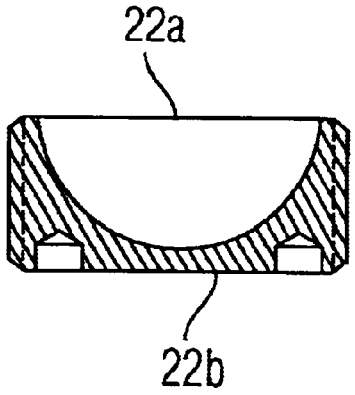
FIG. 5 is a side view of the propellant holder.
Figure 6:
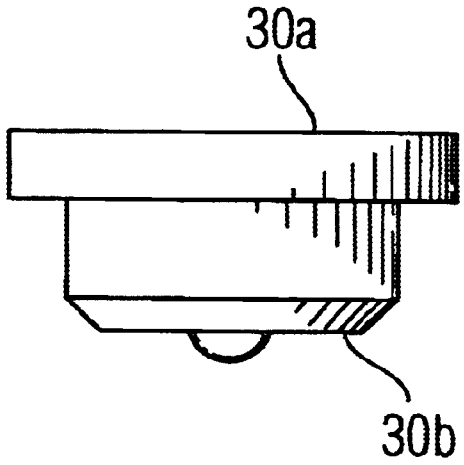
FIG. 6 is a side view of the firing pin.
Figure 7:
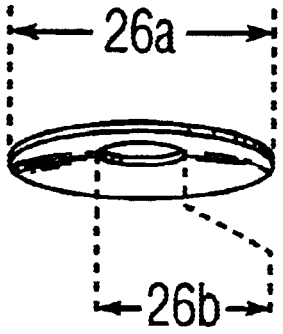
FIG. 7 is a side view of the Belleville spring.

Referring to FIGS. 1, 2 and 3 a first embodiment of the non-lethal munition comprises a top 2 and a base 4, top 2 having a flat surface 2*a* and an opposite recessed surface 2*b*, with recessed surface 2*b* having a slit 6 disposed around the edges of top recessed surface 2*b*. Recessed surface 2*b* has a raised center portion 8 and a grooved portion 10 extending around raised portion 8. Base 4 has a flat surface 4*a* and a recessed surface 4*b*, recessed surface 4*b* has a slit disposed around the edge of base recessed side 4*b*, with base 4 having a hole 12 in its diameter and retaining means 14 affixed to a groove in base recessed side 4*b* of hole 12. The munition has an initiator body 16 having an inside diameter 16*a* and an outside diameter 16*b* and a top portion 16*c* and a bottom portion 16*d*. Initiator body outside diameter 16*b* has an O-ring 18 sealingly disposed therearound and which serves as a gas seal between initiator body 16 and base 4. O-ring 18 is sealed with a silicone-grease. Initiator body 16 has vertically oriented gas vents 20 and a propellant channel 21. A charge holder 22 containing propellant material is disposed within initiator body 16. Charge holder 22 has a top portion 22*a* and a bottom portion 22*b*, with charge holder top portion 22*a* being adapted to be received by initiator bottom portion 16*d* of initiator threaded connection on outer perimeter of charge holder 22 and initiator body 16 engaging base 4 by base retaining means or base retaining ring 14.

The non-lethal munition initiating means comprises a primer 24 and a firing pin 30. Primer 24 is integral to initiator body 16 and positioned above charge holder 22. A Belleville spring 26 has an outer diameter 26*a* and inner diameter 26*b*. Belleville spring 26 is secured and disposed in initiator top portion 16*c* by means comprising an upper and lower retaining ring 28. Firing pin 30 has an upper end 30*a* and lower end 30*b*, with firing pin lower end 30*b* being disposed in spring 26 and firing pin upper end 30*a* being in contact with raised portion 8 of top 2. A flexible sleeve 32 composed of Kevlar® has opposite ends and forms a Kevlar® airbag. The ends of sleeve 32 are fixed to slits 6 of top 2 and base 4 by an epoxy adhesive, thus sealing top 2 and base 4. Kevlar® sleeve 32 is capable of folding when top 2 and base 4 are compressed together and capable of expanding in an axial direction when expansive forces act upon top 2 and base 4. Upon application of pressure by a target pedestrian on top 2 firing pin 30 is lowered and crushes primer 24, thereby producing a spark which ignites the propellant contained within the charge holder 22 and forces propellant gases through gas vents 20 resulting in axial forces from propellant gases acting upon top 2.

FIGS. 4–7 provide separate views of initiator body 16, charge holder 22, firing pin 30 and Belleville spring 26, respectively.

Top 2 and base 4 of the non-lethal munition are generally composed of aluminum alloy, type 6061-T6 or T651 under specification AMS-QQ-A-255/B; however, it will be understood by those of skill in the art, that any rigid material capable of transferring the expansion energy to the target could be used, and all such materials are within the scope of the inventive subject matter. Top 2, base 4 and the inner mechanisms are sealed by flexible Kevlar® sleeve 32 which is fixed to top 2 and base 4 by an appropriate epoxy seal, known to those of skill in the art. While Kevlar® is a preferred material for the present invention a broad range of high-strength, flexible materials may be used as selected by one skilled in the art. All such materials are within the scope of the inventive subject matter. Examples include composite fiber, copolymer, and poly-paraphenylene terephthalamide materials.

Charge holder 22 is generally composed of Cres steel, type 17-4PH Normalized, specification AMS 5643, and is adapted to physically screw into base 4; however, any means of mechanically affixing charge holder 22 to base 4 is within the spirit of the inventive subject matter. Referring again to FIG. 1, the house shaped figures on either side of threaded portion of base 4 are access holes which allow charge holder 22 to be screwed in and out of base 4 by the use of a spanner wrench type tool. Initiator body 16 is generally composed of a steel alloy, type 4130, specification AMS-S-6758 and bottom portion 16*b* is adapted to receive top portion of the charge holder 22*a* with initiator body 16 being secured to base 4 by steel base retaining ring 14. Initiator body 16 has an O-ring 18 between it and base 4. O-ring 18 is made of Buna N rubber and is sealed with a silicone grease. The presence of O-ring 18 and silicone grease prevents gas leakage between initiator body 16 and base 4. Initiator body 16 also contains primer 24 which is built into and is integral to initiator body 16.

A suitable primer 24 is one that has enough energy output to ignite the main charge or propellant material in charge holder 22. An example of such a primer includes: Primer PVU-17A, NSN: 1377-01-108-1438. These and other such primers are known to those in the munition arts. The primer may be composed of a brass alloy, identified in specification ASTM 819.

Belleville spring 26 may be composed of steel with a sufficient spring constant at 165 lbs to compress or may be composed of materials of similar mechanical and physical properties known to those of skill in the art. Belleville spring 26 is secured to initiator 16 by upper and lower steel retaining rings 28 and are in physical attachment with initiator body 16.

Belleville spring 26 acts as the discriminator of munition initiation. Belleville spring 26 requires approximately 165 lbs of force to compress and allows firing pin 30 to come into contact with primer 24. Other types of springs or similar devices that provide similar force may be substituted by one skilled in the art. Firing pin 30 may be made of brass alloy, described in specification ASTM 819, and is disposed in inner diameter 26*b* of Belleville spring 26.

The firing pin contemplated in the inventive subject matter is a matter of choice; however, one of skill in the art will understand that the specific firing pin used and its geometry is determined by the firing requirements of the initiator and is specifically mated with the primer.

A variety of propellants may be selected for use with the invention such as an oxidizer modified nitramine propellant; however, any propellant capable of producing an 1,800 pound force for a minimum of 0.010 seconds or 10 ms within the non-lethal munition is within the scope of the inventive subject matter. Examples of such propellants are gun-type propellants disclosed in U.S. Pat. No. 5,602,361;

5,616,883; and 5,695,216. One specific example of a propellant that can be used in the present invention comprises from about 70 weight percent to about 82 weight percent Cyclotrimethylenetrinitramine (RDX), from about 10 weight percent to about 15 weight percent Cellulose Acetate Butyrate (CAB), from about 6 weight percent to about 9 weight percent Acetyl Triethyl Citrate (ATEC), from about 2 weight percent to about 4 weight percent Hydroxypropyl Cellulose (HPC), from about 0.5 weight percent to about 1 weight percent Vestenamer, and from about 0.3 weight percent to about 0.5 weight percent Ethyl Centralite (EC) that is disclosed in U.S. patent application Ser. No. 09/832,157. However, one skilled in the art may select any airbag propellant formulation that can meet the force and time requirements described above.

The inventive subject matter further contemplates a safety mechanism or restraint that prevents premature linear expansion of the device. Such mechanisms under consideration include shear pins, firing pin misalignment mechanisms and removable components of the critical firing chain. Also contemplated are electronic safeties which are comprised of logic circuitry that selectively signals GO/NO-GO signals to the primer. The application of such restraints are known to those of ordinary skill in the munition arts.

When a target pedestrian steps on the device, top 2 lowers firing pin 30, slightly deforming Belleville spring 26 in a downward position, allowing firing pin 30 to crush primer 24. Crushing primer 24 produces a spark down propellant channel 21 and into charge holder 22. The propellant ignites, producing propellant gases which move through gas vents 20 and exert an axial force on top 2, causing foot or ankle injury on the target pedestrian. Forces of magnitude of about 7.4±1.8 KN are required to cause foot or ankle injury as reported in James R. Funk et al., "Estimation of Fibula Load-Sharing During Dynamic Axial Loading of the Lower Extremity", Automobile Safety Laboratory, University of Virginia. In this report, axial impact tests. were conducted on twenty cadaver specimens to determine the injury tolerance of the foot/ankle complex to dynamic axial loading. It was determined that the peak loads for specimens having foot/ankle injuries was 7.4±1.8 KN.

In another embodiment, the means for disposing Belleville spring 26 comprises a grooved initiator which has been adapted for receiving and securing Belleville spring 26 at the top of initiator 16*a*. Base retaining means 14 may also be adapted to be grooved to accept and secure initiator 16 and charge holder 22.

In yet another embodiment contemplated by the inventive subject matter, gas vents 20 may also be horizontal.

In still another embodiment contemplated by the inventive subject matter, telescoping rings or other mechanisms that restrict radial expansion of the airbag and transfers all expansion energy into an axial displacement or piston-like motion against the target pedestrian or vehicle, are included. The telescoping rings can be fabricated from many different materials such as high strength plastics, metals, metal alloys, composites or even metal or cloth fabric. In general, the radial expansion of the device is also controlled by the shape of the Kevlar® bag. The Kevlar® bag is a cylinder that is tapered towards top 2 and is folded or collapsed into the body of the munition during assembly. When the munition is activated, the Kevlar® bag expands to its tapered cylindrical configuration; however, the fibers of the Kevlar® do not stretch so radial expansion is restricted until the bag is fully inflated. The tapered configuration aids in packing and collapsing the nonlethal airbag munition during assembly.

In still another embodiment, the inventive subject matter may optionally comprise a collar. The collar is a structural member that protects the airbag in the collapsed configuration. The function of the telescoping rings is replaced by the collar in the collapsed configuration.

In still another embodiment, a righting or stabilizing mechanism is added to the non-lethal airbag munition to ensure that the munition does not rest on its circumference. This could simply be little metal "fingers" like leaf springs that extend out from the circumference so the munition would be forced to rest on top 2 or base 4.

In yet another embodiment contemplated in the inventive subject matter, the munition can be scaled up to disable target vehicles. The force produced by the non-lethal munition could be made sufficient to dissipate 170,000 newton-meters (1.25 million foot-pounds), the kinetic energy produced by a vehicle weighing 6,800 kilograms (15,000 pounds) and traveling at 80 kilometers per hour (50 miles per hour), for example. One of skill in the propellant and munition arts will know how to scale up the munition of the inventive subject matter to produce the required dissipative forces.

DEPLOYMENT OF THE NON-LETHAL AIRBAG MUNITION

The non-lethal airbag munition can be hand deployed with the same tactical constraints and flexibilities as current hand deployed systems. The number of personnel required to construct the area for denial will be dependent on the desired size of the area and current tactics. The munition can also be designed to be used in a system similar to or in place of the MOPMS, Volcano or similar mine dispensing system. The munition can also be configured to be dispensed from current sized artillery rounds, and it is anticipated that only minor modifications, if any, will be required to adapt the hand emplaced system or artillery delivered munitions.

The non-lethal airbag munition is expected to function effectively regardless of whether or not it is upside down or "rightside" up, as long as it is resting on either top 2 or base 4. Thus, a military or police force need only deploy the non-lethal airbag munition in the area to be denied with only minimal concern about how the munition is positioned.

The inventive subject matter being thus described, it will be obvious that the same may be varied in many ways. Such variations are not to be regarded as a departure from the spirit and scope of the inventive subject matter, and all such modifications are intended to be within the scope of the following claims.

We claim:

1. A non-lethal airbag munition comprising:

a top;

a base;

an initiator body containing at least one gas vent and containing means for initiating a propellant material, said initiator body being fixed to and sealed within said base and positioned above said propellant material, said initiation means comprising a firing pin disposed on top of said initiator body and a primer disposed within said initiator body;

a holder, located within a bottom portion of said initiator body, said propellant material located therein; and, a flexible sleeve attached to and sealing said top and said base, said sleeve being capable of compressing when said top and said base are in a compressed state and expanding in an axial direction when said propellant is initiated, wherein upon application of pressure by a target pedestrian on said top lowers said firing pin into said primer, igniting said propellant, producing gases which act upon said top.

2. The munition of claim 1, wherein said firing pin contacts and crushes said primer, producing a spark to ignite said propellant material.

3. The munition of claim 1, wherein said initiator gas vents are vertical.

4. The munition of claim 1, wherein said propellant provides 1,800 pounds of force for 10 ms in said munition.

5. The munition of claim 1, wherein said propellant is an oxidizer modified nitramine propellant.

6. The munition of claim 1, wherein said flexible sleeve material is selected from the group consisting of composite fiber, copolymer, and poly-paraphenylene terephthalamide materials.

7. The munition of claim 1, wherein said sleeve end attaching to said top is more inwardly tapered than said sleeve end attaching to said base.

8. The munition of claim 1, wherein said munition initiation discriminates based on the weight of said target pedestrian.

9. The munition of claim 1, wherein initiation of said munition produces a minimum force of 7.4±1.8 KN sufficient to cause foot or ankle injury.

10. The munition of claim 1, wherein said munition is activatable and produces foot and ankle injuries upon contact by a target pedestrian whether said munition is oriented on said top or said base.

11. A non-lethal airbag munition comprising:

a top;

a base;

initiator body containing at least one gas vent and containing means for initiating a propellant material, said initiator body being fixed to and sealed within said base and positioned above said propellant material, said initiation means comprising a firing pin disposed on top of said initiator body and a primer disposed within said initiator body;

a holder, located within a bottom portion of said initiator body, said propellant material located therein; and, a flexible sleeve attached to and sealing said top and said base, said sleeve being capable of compressing when said top and said base are in a compressed state and expanding in an axial direction when said propellant is initiated, wherein upon application of pressure by a target vehicle on said top lowers said firing pin into said primer, igniting said propellant, producing gases which act upon said top.

* * * * *